US007135970B2

(12) United States Patent
Kowal et al.

(10) Patent No.: US 7,135,970 B2
(45) Date of Patent: Nov. 14, 2006

(54) METHOD AND DEVICE FOR INTRUSION DETECTION USING AN OPTICAL CONTINUITY SYSTEM

(75) Inventors: Sandra E. Kowal, Boynton Beach, FL (US); Frank E. Lambrecht, Boynton Beach, FL (US); Edwin L. Williams, Port St. Lucie, FL (US)

(73) Assignee: DSFE Security Systems International, Inc, Boynton Beach, FL (US)

( * ) Notice: Subject to any disclaimer, the term of this patent is extended or adjusted under 35 U.S.C. 154(b) by 101 days.

(21) Appl. No.: 10/926,928

(22) Filed: Aug. 26, 2004

(65) Prior Publication Data

US 2006/0044136 A1 Mar. 2, 2006

(51) Int. Cl.
*G08B 13/18* (2006.01)

(52) U.S. Cl. ..... 340/555; 340/568.2; 340/568.3

(58) Field of Classification Search ..... 340/568.2, 340/568.3, 600, 571, 555, 556
See application file for complete search history.

(56) References Cited

U.S. PATENT DOCUMENTS

| | | | | |
|---|---|---|---|---|
| 4,321,463 | A | | 3/1982 | Stecher |
| 4,591,709 | A | | 5/1986 | Koechner et al. |
| 4,970,494 | A | | 11/1990 | Keely et al. |
| 5,055,827 | A | | 10/1991 | Philipp |
| 5,202,673 | A | * | 4/1993 | Conrad ..... 340/524 |
| 5,416,467 | A | | 5/1995 | Ohta et al. |
| 5,680,104 | A | | 10/1997 | Slemon et al. |
| 5,748,803 | A | * | 5/1998 | Schielke ..... 382/275 |
| 5,854,588 | A | | 12/1998 | Dockery |
| 6,134,303 | A | | 10/2000 | Chen |
| 6,150,940 | A | * | 11/2000 | Chapman et al. ..... 340/568.3 |
| 6,759,957 | B1 | | 7/2004 | Murakami et al. |
| 2002/0130776 | A1 | | 9/2002 | Houde |

* cited by examiner

*Primary Examiner*—John Tweel, Jr.
(74) *Attorney, Agent, or Firm*—Laurence A. Greenberg; Werner H. Stemer; Ralph E. Locher

(57) ABSTRACT

A fiber optic based security system is disposed on or in a structure such as a wall, roof, floor, ceiling, container, and/or ground. The security system contains an optical cable having first and second ends and an interface unit connected to both ends of the optical cable. The interface unit generates a specific light signal injected into the first end. The interface unit receives the specific light signal from the second end after the specific light signal propagates through the optical cable. The interface unit then determines if the specific light signal received falls within a given threshold and outputs an alarming signal indicating if the specific light signal received falls outside of the given threshold. An alarm system receives the alarming signal from the interface unit. The alarm system is activated if the interface unit indicates that the specific light signal falls outside of the given threshold.

28 Claims, 2 Drawing Sheets

METHOD AND DEVICE FOR INTRUSION DETECTION USING AN OPTICAL CONTINUITY SYSTEM

BACKGROUND OF THE INVENTION

Field of the Invention

The invention relates, generally, to security systems, and more specifically, to an optically based security system.

A number of expensive and elaborate security systems are available to protect homes and commercial buildings against unauthorized entries. In a typical system, a variety of sensors are used to detect the opening of doors or windows or to detect motion within a dwelling and then to activate an alarm upon detection of an unauthorized entry. However, it is axiomatic that the security system must accommodate the normal activities of the occupants without triggering the alarm. This normally requires that the system be disarmed when entering the unit and be armed when leaving the unit. Therefore, such systems only cover and protect designated areas of ingress and egress such as doors and windows and do not cover entry through a forced opening (e.g. hole) in a wall, roof, ceiling or floor. In addition, these systems only function when they are activated. Furthermore, such systems are prone to false alarms and an estimated 97% of all automated alarm actuations are considered to be false alarms for various reasons such as the system was not deactivated in time upon entry of an authorized individual.

A simple method for sensing an intrusion electronically can be had using infrared detectors and cameras. Varying levels of infrared radiation are monitored either actively, by first emitting IR and then evaluating the reflected signal, or passively, by only receiving the infrared frequencies radiating in the monitored area. Once a variation is detected an alarm is activated. However, once again such systems do not detect attempted entrance by creating an opening in the wall, roof, ceiling or floor. In addition, such devices are limited in their area of use and are not effective for protecting a wide area.

Cameras are also popular as security devices but cameras require constant monitoring by an individual and are limited by the visual distance of the camera and the attention span of the guard.

One solution for protecting areas that does not require the use of alarms on doors and windows for detecting unauthorized entry is to utilize fiber optic technology that has been in use for many years, primarily in the field of computers and telecommunications.

U.S. Pat. No. 5,680,104 to Slemon describes a fiber optic security system containing an optical emitter, an optical fiber and a detector. A random signal generator controls the emitter and triggers the emitter to output a light signal transmitted through the optical fiber and received by the detector. The detector compares the received light signal from the emitter with a reference light signal. However, Slemon requires a complicated feedback loop of electronic components for controlling and operating the system which results in an unnecessarily inefficient, complicated and expensive system. Additionally, this patent describes a portable system.

U.S. Pat. No. 5,055,827 to Phillip describes a fiber optic security system specifically configured for appliances and requires a direct attachment of the optical fiber to the appliance thus limiting the scope of applicability of the system. If the appliance is moved and this results in the severing of the optical fiber or light within the optical fiber being attenuated outside of an acceptable range an alarm is sounded.

U.S. Pat. No. 4,591,709 to Koechner et al. describe an optical fiber security system which requires two fibers be set in place and the optical characteristics of the two be compared to determine a breach of security. The fibers are strategically placed far enough apart such that an intruder will change the characteristics of only one of the fibers resulting in the alarming of the system.

U.S. Pat. No. 5,416,467 to Ohta et al. describe a system wherein the deformation of the optical fiber causes a loss in intensity of the optical signal at the detector. The loss of intensity causes an alarm condition. Such a system is configured for fences and the optical fiber must be made into a fence in order to operate properly.

U.S. Pat. No. 4,321,463 to Stecher describes a versatile laser and fiber optic system that can be used not only for intrusion detection, but also for musical instruments. The proper functioning of the device requires transduction of mechanical vibrations to amplitude modulated optical energy. Further processing is required to determine if an alarm condition has been met.

Further publications describe fiber optic security systems that are solely dependent on the level of light received by the detector. No provision is made to harden the system from external light sources that can be connected to the optical fiber to simulate the original light source and thus defeat the system. Such a system is taught in Published U.S. Patent Application 2002/0130776 A1 to Houde.

SUMMARY OF THE INVENTION

It is accordingly an object of the invention to provide a method and a device for intrusion detection using an optical continuity system, which overcomes the herein-mentioned disadvantages of the heretofore-known methods and devices of this general type, which is simple to manufacture and difficult to defeat.

With the foregoing and other objects in view there is provided, in accordance with the invention, a combination of a structure such as a wall, roof, floor, ceiling, container, and/or ground, and a security system disposed on or in the structure. The security system contains an optical cable having first and second ends and an interface unit connected to both of the first and second ends of the optical cable. The interface unit generates a specific light signal injected into the first end of the optical cable, the interface unit receives the specific light signal from the second end of the optical cable after the specific light signal propagates through the optical cable. The interface unit then determines if the specific light signal received falls within a given threshold and outputs an alarming signal indicating if the specific light signal received falls outside of the given threshold. An alarm system receives the alarming signal from the interface unit, the alarm system is activated if the interface unit indicates that the specific light signal falls outside of the given threshold.

In accordance with an added feature of the invention, the interface unit includes a controller and a light-emitting device connected to the first end of the optical cable. The light-emitting device converts an electrical signal into the specific light signal injected into the first end of the optical cable. The interface unit further has a light-receiving device connected between the second end of the optical cable and the controller. The light-receiving device receives and converts the specific optical signal into a second electrical signal and forwards the second electrical signal to the controller for evaluation. If the controller determines the received signal is not within acceptable parameters, an alarm signal is activated, the acceptable parameters to be set in accordance with the intended use of the interface unit.

In accordance with a further feature of the invention, the alarm system has a receiver and the control unit has a transmitter for transmitting the alarming signal to the receiver of the alarm system.

In accordance with an additional feature of the invention, the controller evaluates the second electrical signal against the given threshold and the given threshold has a parameter being the amplitude, frequency, phase, pulse pattern and/or pulse width. The given threshold includes a high threshold value and a low threshold value and the alarm system is inactive when the second electrical signal is between the high threshold value and the low threshold value.

In accordance with a concomitant feature of the invention, the controller can be a microprocessor, microcomputer, microcontroller or an application specific integrated circuit. Ideally, such a controller can be programmed to generate the first specific electrical signal in unlimited variations which supplies a high security aspect to the security system. For instance, the controller can continuously vary the first specific electrical signal making it impossible to inject a substitute light source signal into the optical fiber for defeating the system.

Other characteristic features of the invention are set forth in the appended claims.

Although the invention is illustrated and described herein as embodied in a method and a device for intrusion detection using an optical continuity system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 2:
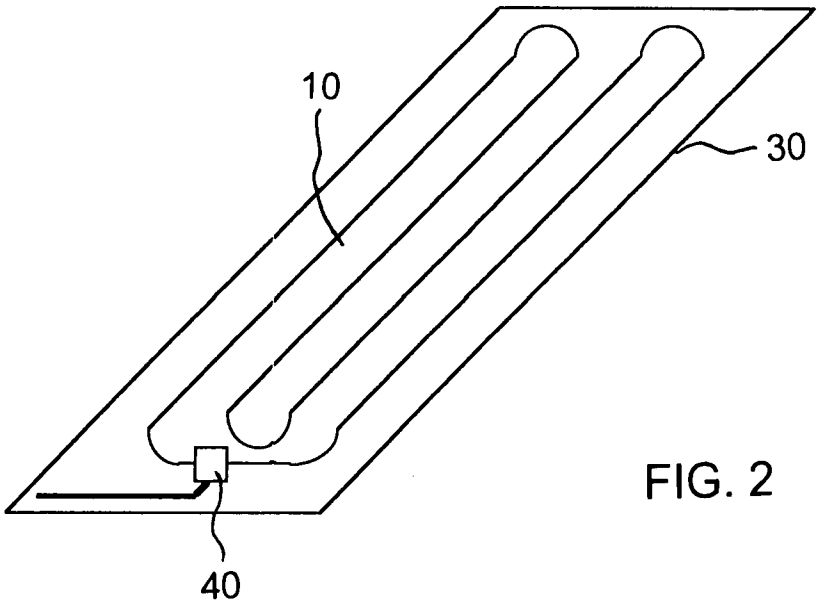
FIG. 2 is a diagrammatic illustration of the optical fiber based intrusion detection system installed in a roof or ceiling.
Figure 1:
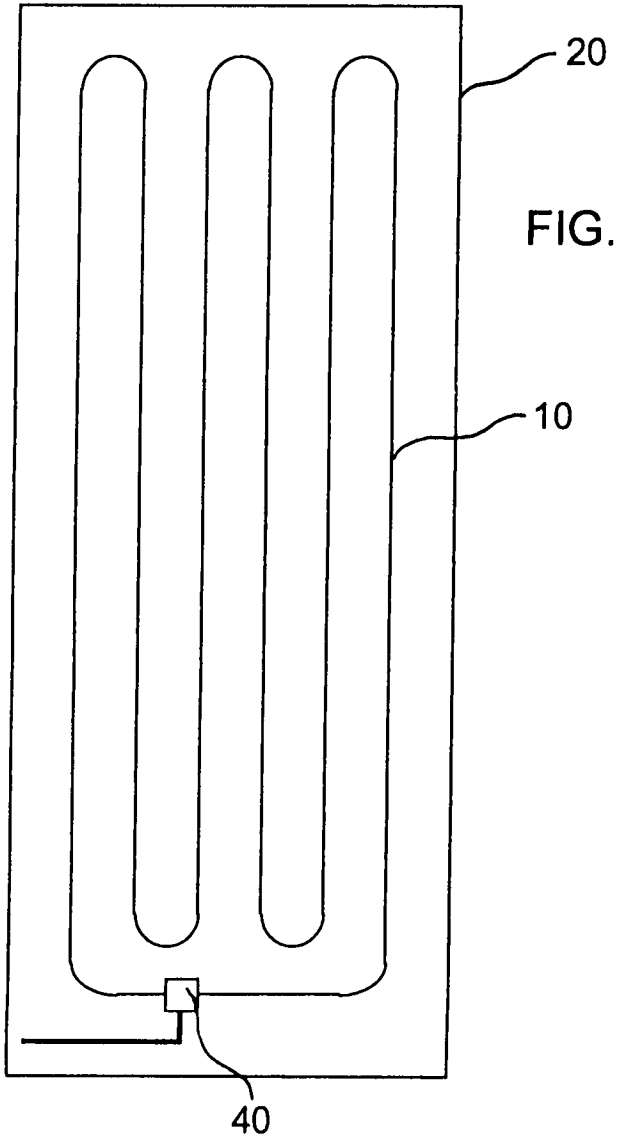
FIG. 1 is a diagrammatic illustration of an optical fiber based intrusion detection system installed in a wall according to the invention.

In all the figures of the drawing, sub-features and integral parts that correspond to one another bear the same reference symbol in each case. Referring now to the figures of the drawings in detail and first to FIG. 1 thereof, there is shown an optical fiber based intrusion detection system. The intrusion detection system is formed of an optical fiber or fiber optic cable 10 that is attached to a surface of a wall 20 for detecting an intrusion through the area of the wall 20. Alternatively, the cable 10 can be embedded into the wall 20 or disposed in a spacing formed in the wall 20. As shown in FIG. 2, the cable 10 can run along or be embedded into a roof 30, ceiling, floor, liquid filled area, liquid filled container, ground, or any other area in which the cable 10 can be laid against or incorporated therein.

The cable 10 can be laid in any pattern in the structure 20, 30 so long as the pattern protects the area from the expected physical dimensions of an intruder and covers the area of the structure. For instance, if the intruder is expected to be a person a 6–12 inch spacing of the cable 10 would be adequate. However, a much finer spacing, a grid configuration, a crisscrossing layout, etc. could be implemented to prevent the undetected entrance of an electronic intruder.

The objective of the intruder detection system is that the cable 10 is interrupted or disturbed upon an attempted entry into the area protected such that an alarm will be triggered. The continuity of the optical fiber cable 10 is monitored by way of an interface unit 40.

Figure 3:
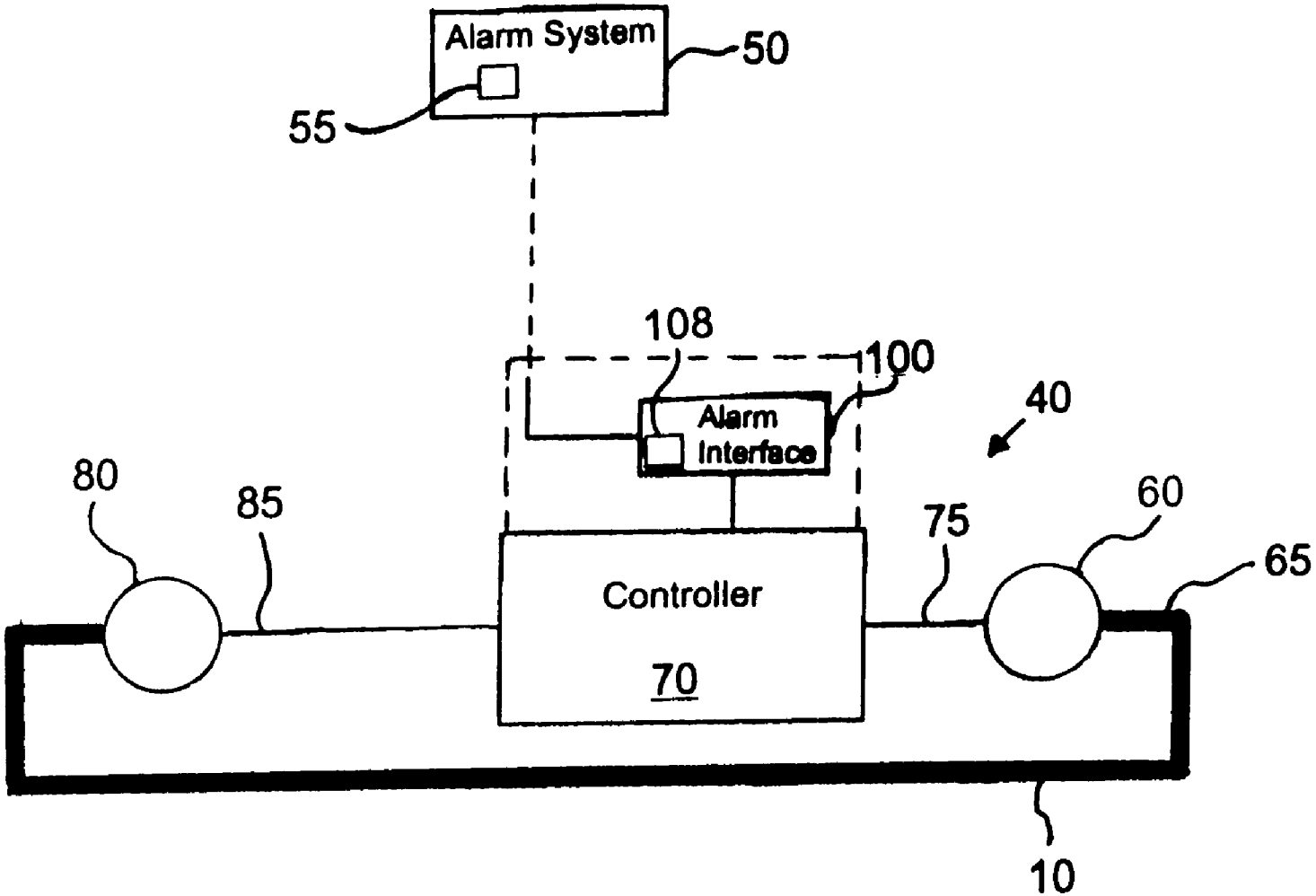
FIG. 3 is a circuit diagram of an interface unit of the intrusion detection system.

The interface unit 40 is shown in greater detail in FIG. 3 with the cable 10 being inserted therein at both ends. The cable 10 is preferably an optical fiber and is connected at opposite ends to a light-emitting device (LED) 60 and to a light-receiving device 80. The LED 60 changes a first electrical signal 75 into a light signal 65 that is carried in the optical fiber 10 to the light-receiving device 80. The light-receiving device 80 changes the light signal 65 into a second electrical signal 85.

The second electrical signal 85 is sent to a controller 70. The controller 70 can be in the form of a microprocessor, a microcomputer, a microcontroller or other such component(s) capable of providing the necessary signal and evaluation functions. The controller 70 generates the first electrical signal 75 that is sent to the LED 60 and in turn is converted into the light signal 65.

The first electrical signal 75 generated by the controller 70 and the resulting light signal 65 going through the optical fiber 10 can be coded so that if an attempt is made to defeat the system by way of supplying a secondary light source into the optical fiber 10, the system will immediately recognize the new signal as false and will activate a signal indicating an alarm condition. The encoding process can be random or preset by software operating in the controller 70. Because the light signal 65 is unique, one cannot defeat the system by supplying an alternative light source into the cable because the alternative light source cannot predict or emulate the first specific electrical signal 75.

The second electrical signal 85 is sent to the controller 70 for evaluation. The controller 70 compares the second electrical signal 85 with the first electrical signal 75 and makes a determination as to whether the two signals 75, 85 match each other within predetermined limits and within a predetermined time frame. If the limits are exceeded, the controller 70 activates an alarm signal for activating an alarm system 50. The alarm system 50 may be placed anywhere so long as it is connected to the interface unit 40. Of course the alarm system 50 may be hardwired connected to the interface unit 40 or may receive a signal transmitted by a transmitter 108 of an alarm interface 100 and received in a receiver 55 of the alarming system 50. In this manner, the alarming system 50 may be physically disconnected from the structure which is being monitored by the fiber based intrusion system. The alarm interface 100 may be integrated in the controller 70 or connected to the controller 70.

We claim:

1. A method of operating a security system, which comprises the steps of;

laying an optical cable throughout a structure to be protected;

generating a specific light signal, from only a single first electrical signal, and injecting the specific light signal into a first end of the optical cable;

receiving the specific light signal from a second end of the optical cable after the specific light signal propagates through the optical cable;

determining if the specific light signal received falls below a given threshold; and setting an alarm condition if the specific light signal received falls below the given threshold.

2. The method according to claim 1, which further comprises the steps of:

generating the single first electrical signal which is converted into the specific light signal by a light-emitting device; and converting the specific light signal received from the second end of the optical fiber into a second electrical signal using a light-receiving device.

3. The method according to claim 2, which further comprises generating the single first electrical signal as a random or pseudorandom signal.

4. The method according to claim 3, which further comprises the steps of:

comparing a difference between the received and transmitted signals to the given threshold being a low threshold value;

generating an alarming signal if the transmitted signal is not above the low threshold value; and setting the alarm condition for activating an alarm system.

5. The method according to claim 4, which further comprises the steps of:

transmitting the alarming signal wirelessly; and selecting the given threshold to have at least one parameter selected from the group consisting of amplitude, frequency, phase, pulse width and pulse pattern.

6. The method according to claim 2, which further comprises generating the single first electrical signal by changing one of its amplitude, frequency, phase, pulse width and pulse pattern between consecutive ones of single first electrical signals.

7. The method according to claim 6, which further comprises using a controller selected from the group consisting of microprocessors, microcomputers, microcontrollers and application specific integrated circuits for generating the specific first electrical signal.

8. The method according to claim 2, which further comprises:

providing a light-emitting diode, laser diode or other device capable of converting an electrical signal to a light signal as the light-emitting device; and selecting the light-receiving device from the group consisting of photo-detectors and phototransistors.

9. A security system, comprising:

an optical cable having ends including a first end and a second end;

an interface unit connected to both of said first and second ends of said optical cable, said interface unit generating a specific light signal, derived from only a single first electrical signal, and injected into said first end of said optical cable, said interface unit receiving the specific light signal from said second end of said optical cable after the specific light signal propagates through said optical cable, said interface unit determining if the specific light signal received falls below a given threshold and outputs an alarming signal indicating if the specific light signal received falls below the given threshold; and an alarm system receiving the alarming signal from said interface unit, said alarm system being activated if the alarming signal indicates that the specific light signal falls below the given threshold.

10. The security system according to claim 9, wherein said interface unit includes:

a controller generating the single first electrical signal;

a light-emitting device connected between said controller and said first end of said optical cable, said light-emitting device receiving and converting the single first electrical signal into the specific light signal injected into said first end of said optical cable; and a light-receiving device connected between said second end of said optical cable and said controller, said light-receiving device receiving and converting the specific light signal into a second electrical signal and forwards the second electrical signal to said controller for evaluation.

11. The security system according to claim 10, wherein:

said light-receiving device is selected from the group consisting of photo-detectors and phototransistors; and said light-emitting device is a light-emitting diode, laser diode or other device capable of converting an electrical signal to a light signal.

12. The security system according to claim 10, wherein:

said alarm system has a receiver; and said interface unit has a transmitter for transmitting the alarming signal to said receiver of said alarm system.

13. The security system according to claim 10, wherein said interface unit has an alarm interface connected between said controller and said alarm system or integrated in said controller.

14. The security system according to claim 11, wherein said controller evaluates the second electrical signal against the given threshold and the given threshold has at least one parameter selected from the group consisting of amplitude, frequency, phase, pulse width and pulse pattern.

15. The security system according to claim 14, wherein the given threshold is a low threshold value and an alarm function is inactive when the second electrical signal is above said low threshold value.

16. The security system according to claim 10, wherein said controller is selected from the group consisting of microprocessors, microcomputers, microcontrollers, and application specific integrated circuits.

17. The security system according to claim 10, wherein said controller is programmed to form the single specific electrical signal from only one electrical signal.

18. In combination with a structure to be protected, a security system disposed on or in the structure, the security system comprising:

an optical cable having ends including a first end and a second end;

an interface unit connected to both of said first and second ends of said optical cable, said interface unit generating a specific light signal derived from only a single first electrical signal and injecting the specific light signal into said first end of said optical cable, said interface unit receiving the specific light signal from said second end of said optical cable after the specific light signal propagates through said optical cable, said interface unit determining if the specific light signal received falls below a given threshold and outputs an alarming signal indicating if the specific light signal received falls below the given threshold; and an alarm system receiving the alarming signal from said interface unit, said alarm system being activated if the alarming signal indicates that the specific light signals falls below the given threshold.

19. The security system according to claim 18, wherein said interface unit includes:

a controller generating the single first electrical signal;

a light-emitting device connected between said controller and said first end of said optical cable, said light-emitting device receiving and converting the single first electrical signal into the specific light signal injected into said first end of said optical cable; and a light-receiving device connected between said second end of said optical cable and said controller, said light-receiving device receiving and converting the specific light signal into a second electrical signal and forwards the second electrical signal to said controller for evaluation.

20. The security system according to claim 19, wherein:

said light-receiving, device is selected from the group consisting of photo detectors and phototransistors; and said light-emitting device is a light-emitting diode, laser diode or other device capable of converting an electrical signal to a light signal.

21. The security system according to claim 19, wherein:

said alarm system has a receiver; and said interface unit has a transmitter for transmitting the alarming signal to said receiver of said alarm system.

22. The security system according to claim 19, wherein said interface unit has an alarm interface connected to or part of said controller.

23. The security system according to claim 19, wherein said controller evaluates the second electrical signal against the given threshold and the given threshold has a parameter selected from the group consisting of amplitude, frequency, phase, pulse width, and pulse pattern.

24. The security system according to claim 23, wherein the given threshold is a low threshold value and an alarm function is inactive when the second electrical signal is above said low threshold value.

25. The security system according to claim 19, wherein said controller is selected from the group consisting of microprocessors, microcomputers, microcontrollers and application specific integrated circuits.

26. The security system according to claim 19, wherein said controller uses programming to form the single first electrical signal.

27. The security system according to claim 26, wherein said controller continuously varies the single first electrical signal.

28. The security system according to claim 18, wherein the structure is selected from the group consisting of walls, roofs, floors, ceilings, containers, and ground.

* * * * *